US009168747B2

(12) United States Patent
Redding et al.

(10) Patent No.: US 9,168,747 B2
(45) Date of Patent: Oct. 27, 2015

(54) MULTI-LAYER ELECTROFORMED NOZZLE PLATE WITH ATTENUATION POCKETS

(71) Applicant: XEROX CORPORATION, Norwalk, CT (US)

(72) Inventors: Gary D. Redding, Victor, NY (US); Mark A. Cellura, Webster, NY (US); Peter J. Nystrom, Webster, NY (US); Andrew W. Hays, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 67 days.

(21) Appl. No.: 14/048,196

(22) Filed: Oct. 8, 2013

(65) Prior Publication Data

US 2015/0097897 A1 Apr. 9, 2015

(51) Int. Cl.
*B41J 2/045* (2006.01)
*B41J 2/14* (2006.01)

(52) U.S. Cl.
CPC ..... *B41J 2/1433* (2013.01); *B41J 2/04521* (2013.01)

(58) Field of Classification Search
CPC .... B41J 2/14233; B41J 2/055; B41J 2/04521; B41J 2002/14306
See application file for complete search history.

(56) References Cited

U.S. PATENT DOCUMENTS 5,689,291 A * 11/1997 Tence et al. ..... 347/10
7,766,463 B2 * 8/2010 Stephens et al. ..... 347/71
2010/0045740 A1 2/2010 Andrews

* cited by examiner

*Primary Examiner* — Juanita D Jackson
(74) *Attorney, Agent, or Firm* — MH2 Technology Law Group LLP

(57) ABSTRACT

An ink jet printhead includes a nozzle plate including a nozzle, a recess in the nozzle plate, and a compliant layer that covers the recess and forms a sealed pocket that may be filled with air or another gas during use of the printhead. During actuation of a piezoelectric element during the ejection of ink from the nozzle, the sealed pocket attenuates an acoustic energy generated by the piezoelectric element, thereby reducing crosstalk to adjacent nozzles by the acoustic energy.

14 Claims, 5 Drawing Sheets

MULTI-LAYER ELECTROFORMED NOZZLE PLATE WITH ATTENUATION POCKETS

TECHNICAL FIELD

The present teachings relate to the field of ink jet printing devices and, more particularly, to methods and structures for a piezoelectric ink jet print head and a printer including a piezoelectric ink jet print head.

BACKGROUND

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored, for example because they can use a wider variety of inks.

Piezoelectric ink jet print heads include an array of piezoelectric elements (i.e., transducers or PZTs). One process to form the array can include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet print heads can typically further include a flexible diaphragm to which the array of piezoelectric elements is attached. When a voltage is applied to a piezoelectric element, typically through electrical connection with an electrode electrically coupled to a power source, the piezoelectric element actuates to bend or deflect. Piezoelectric element actuation causes the diaphragm to flex which, in turn, results in a pressure pulse within an ink chamber and ejection of a quantity of ink from a chamber through one of a plurality of nozzles (i.e., nozzle aperture or nozzle opening) within a nozzle plate (i.e., aperture plate), for example a stainless steel nozzle plate, during printing. The flexing further draws ink into the chamber from a main ink reservoir through an opening to replace the expelled ink.

The use of a pressure wave to eject ink from a nozzle may result in various problems. For example, the pressure wave may propagate through ink supply channels, and may also create acoustic energy that is transmitted through solid printhead structures to result in crosstalk of the pressure pulse or acoustic energy to an adjacent nozzle. Other time-dependent effects may also result from acoustic energy, such as variation in jetting performance during a train of ejected ink droplets during printing. Pressure fluctuations resulting from the pressure pulse during ejection of one ink drop can affect drop ejection of subsequent drops, and may cause variations in drop volume, drop speed, and drop directionality. The printhead may be designed to decrease crosstalk and other adverse effects by attenuating the pressure wave. For example, rather than using a nozzle plate manufactured from stainless steel, the nozzle plate may be manufactured from a compliant material such as a polymer that dampens or attenuates the pressure wave by an amount that decreases crosstalk but still generates a sufficient pressure wave for printing from a desired nozzle.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment of the present teachings, an ink jet printhead may include a printhead manifold comprising an ink chamber therein, a nozzle plate, comprising an outside surface, an inside surface opposite the outside surface, and a recess within the inside surface. The recess may include an intermediate surface at a level between the outside surface and the inside surface. The ink jet printhead may further include a compliant layer attached to the inside surface of the nozzle plate that covers the recess and forms a sealed attenuation pocket within the nozzle plate.

In another embodiment, an ink jet printer may include a printhead, wherein the printhead includes a printhead manifold comprising an ink chamber therein and a nozzle plate. The nozzle plate may include an outside surface, an inside surface opposite the outside surface, and a recess within the inside surface. The recess may include an intermediate surface at a level between the outside surface and the inside surface. The printhead may further include a compliant layer attached to the inside surface of the nozzle plate that covers the recess and forms a sealed pocket within the nozzle plate. The printer may further include a housing that encases the printhead.

In another embodiment, a method for forming an ink jet printhead may include forming a nozzle plate comprising an outside surface and an inside surface opposite the outside surface, forming a recess within the inside surface, the recess comprising an intermediate surface at a level between the outside surface and the inside surface, and attaching a compliant layer to the inside surface of the nozzle plate that covers the recess and forms a sealed pocket within the nozzle plate.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

Forming a nozzle plate from a compliant material such as polyimide rather than from a rigid material such as stainless steel may attenuate the pressure wave during printing and result in a printhead having less crosstalk between nozzles during printing. However, a compliant polymer nozzle plate may have other, less desirable characteristics compared to a more rigid material such as a metal. For example, a polymer film may absorb moisture which leads to dimension changes (e.g., swelling) that may hinder alignment of the nozzle plate with other printhead structures during assembly. Further, the compliant polymer material may deform and dimple during formation of the nozzles within the polymer nozzle plate which may adversely affect ink directionality during printing. Additionally, a polymer nozzle plate may be more susceptible to wear and scratching from contact with paper and other surfaces during printing, assembly, and use. Further, scaling of nozzle openings within a polymer plate becomes more difficult with increasing print resolution and decreasing nozzle sizes as forming small, well-defined nozzle holes within a polymer is a challenge. Additionally, a polymer nozzle plate may be permeable to air which may lead to formation of air bubbles within the printhead, as a negative pressure is often maintained within the printhead compared to the outside of the nozzle plate to decrease leakage or drooling of ink from the nozzles.

An embodiment of the present teachings may result in a nozzle plate including a metal layer that has reduced attenuation compared to some conventional metal nozzle plates and overcomes the problems associated with polymer nozzle plates.

Figure 1:
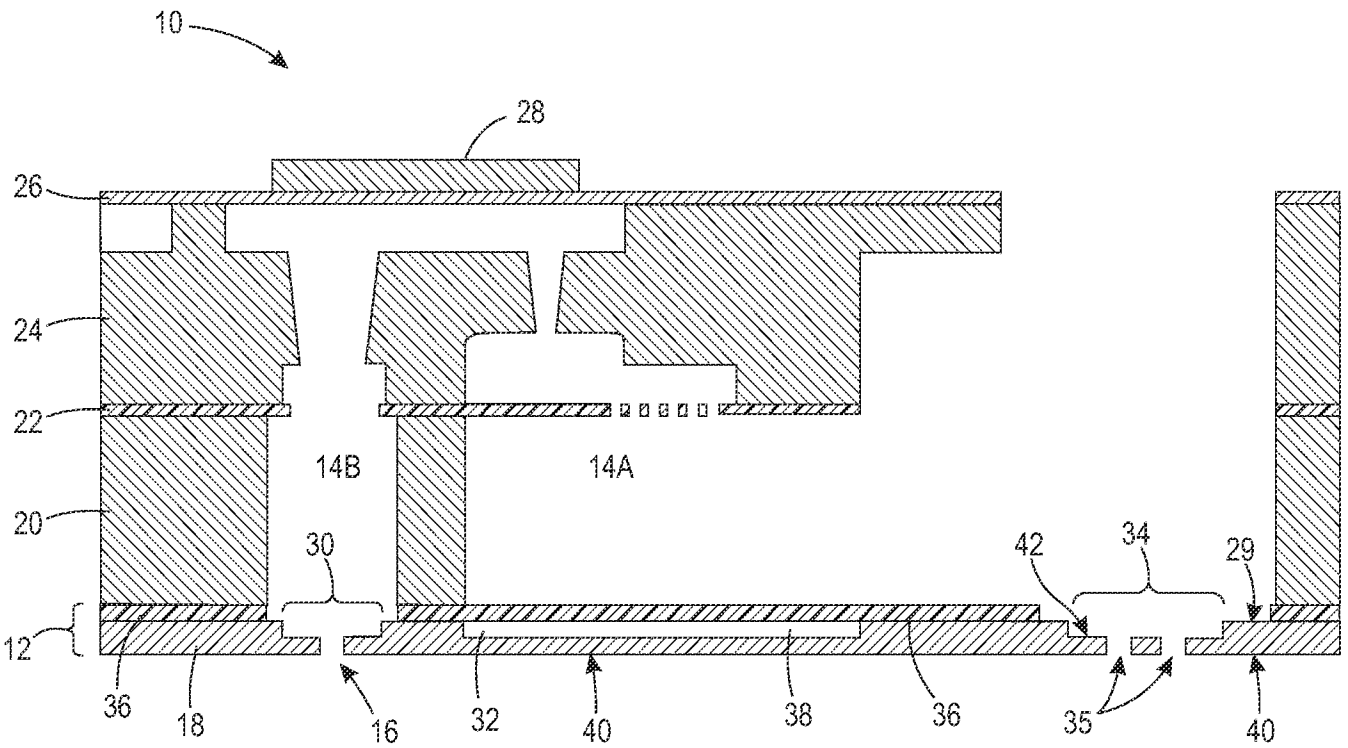
FIG. 1 is a cross section depicting part of a printhead in accordance with an embodiment of the present teachings.

An embodiment of a printhead 10 including a nozzle plate assembly 12 in accordance with an embodiment of the present teachings is depicted in the cross section of FIG. 1. While FIG. 1 depicts various structures that may be found in an exemplary printhead, it will be understood that the embodiments depicted in each of the FIGS. are generalized schematic illustrations and that other components may added or existing components may be removed or modified. The printhead may include various laminated structures that provide a plurality of ink channels 14 through the printhead 10, with each channel 14 having a first section 14A and a second section 14B that ends or terminates at a nozzle (i.e., nozzle aperture) 16 within a nozzle plate 18 from which ink is ejected during printing. For example, the printhead 10 may include an inlet/outlet plate 20, a particulate filter or "rock screen" 22, a vertical inlet 24, a diaphragm or membrane 26, and a piezoelectric element (i.e., piezoelectric transducer, PZT) 28. It will be understood that the printhead 10 of FIG. 1 is a schematic depiction, and various depicted structures may be formed using two or more layers. The printhead structures 20-28 may be formed from one or more metals, alloys, polymers, epoxies, and/or combinations thereof as known in the art. Further, for simplicity, various structures are omitted from the FIG. 1 depiction, such as a standoff layers, flexible printed circuit coupled to the piezoelectric transducer 28, adhesive layers, etc. It will be understood that the FIG. 1 structures 20-24 may be referred to collectively as a "printhead manifold." The printhead manifold 20-24 design of FIG. 1 is exemplary, and other printhead manifold designs are known in the art.

In use, a voltage is applied to the piezoelectric transducer 28 which deflects (i.e., bends) the piezoelectric transducer which, in turn, deflects the diaphragm 26 attached to the piezoelectric transducer 28 with an adhesive (not depicted for simplicity). Deflection of the diaphragm 26 causes a volume decrease and a pressure increase within channel 14B that ejects ink from the nozzle 16 within the nozzle plate 18. Deflection of the diaphragm 26 may also cause a pressure wave that travels back up the ink channel 14B or into the ink channel 14A and is transmitted by acoustic energy through solid printhead structures to adjacent ink channels and nozzles, thereby resulting in crosstalk with other nozzles.

The embodiment of FIG. 1 includes one or more structures that attenuate acoustic energy and crosstalk within a printhead 10. In an embodiment, the nozzle plate 18, which may be formed from metal or metal alloy, for example nickel or nickel alloy, may be patterned to include various recesses or channels in an interior surface 29 of the nozzle plate 18. FIG. 1 depicts a first recess 30 in the nozzle plate 18 around the nozzle 16 and a second recess 32 in the nozzle plate 18 along the ink channel 14B below the particulate filter 22. FIG. 1 further depicts a third recess 34 in the nozzle plate around ink purge vents (i.e., purge apertures) 35 that are used during a cleaning cycle.

In addition to nozzle plate 18 having recesses therein, the nozzle plate assembly 12 may further include a compliant layer 36. In an embodiment, the compliant layer 36 may be formed from a polymer, for example a thermoplastic adhesive such as DuPont™ ELJ. As depicted in FIG. 1, the compliant layer 36 covers one or more recesses 32 in the nozzle plate 18 adjacent to the first section of the ink channel 14A to form a sealed pocket 38 between the compliant layer 36 and the nozzle plate 18. The compliant layer 36 further includes openings therein that allow the passage of ink to the nozzles 16 and to the ink purge vents 35. For purposes of this disclosure, unless otherwise stated, a compliant layer is a flexible polymer layer that physically deflects under pressure from ink 44 within the ink channel 14 during printing or from acoustic energy transmitted through the solid body 20, 24 of the printhead 10 during printing. Thus, during printing, the volume of the sealed pocket 38 will increase and decrease during deflection of the compliant layer 36. The compliance of the compliant layer 36 may be determined by performing a finite element analysis (FEA) and calculating the volume deflection of the compliant layer when a pressure is applied across it.

Figure 2:
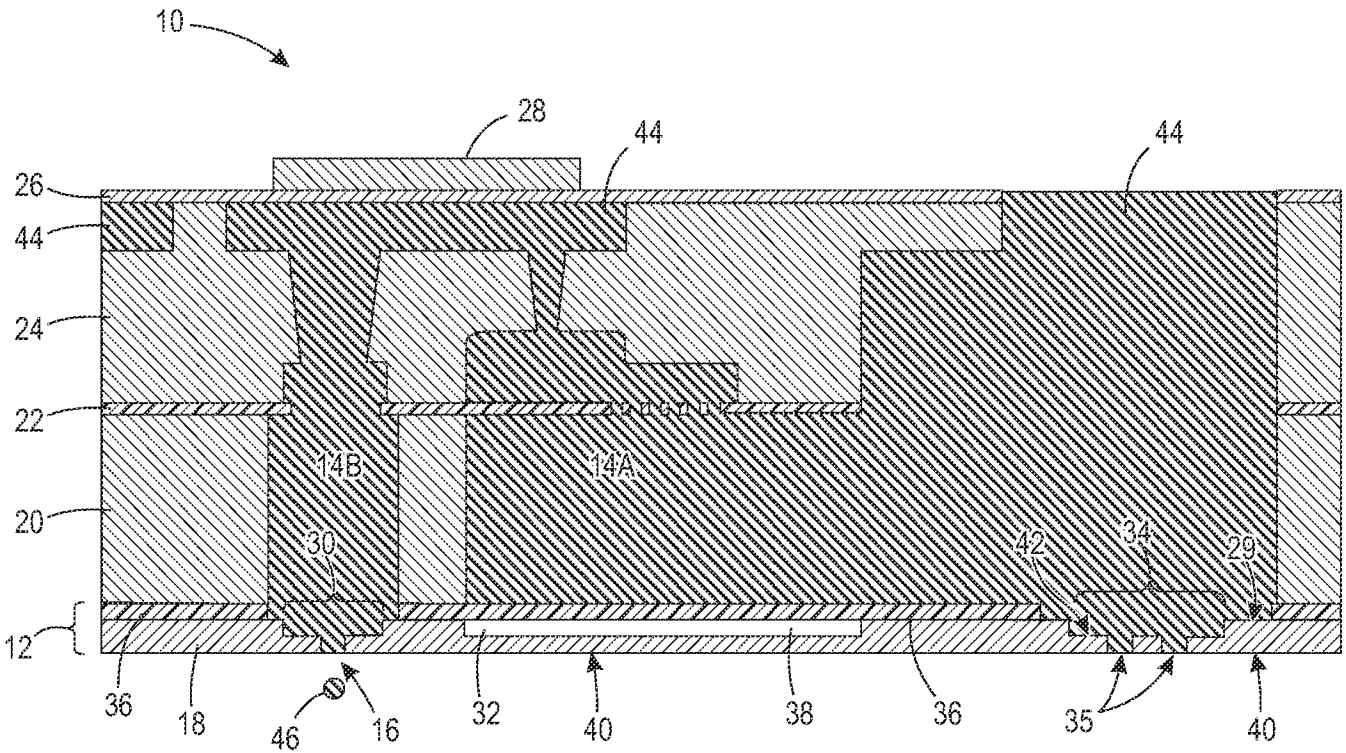
FIG. 2 is a cross section depicting the FIG. 1 structure after filling the structure with ink.

During use of the printhead, the ink channel 14 fills with ink 44 as depicted in FIG. 2 while the sealed pocket 38 remains filled with air or another gas to provide a sealed air pocket. As the piezoelectric element 28 is actuated to eject an ink droplet 46 from the nozzle 16, the piezoelectric element 28 generates an acoustic energy within the ink channel 14B and/or within the solid printhead manifold 20-24 of the printhead 10. As the acoustic wave transmits through the solid printhead manifold 20-24 and/or the ink 44 to the compliant layer 36 that forms the sealed pocket 38, acoustic energy may be absorbed, dampened, or otherwise attenuated by the compliant layer 36 that forms the sealed pocket 38.

In an embodiment, the nozzle plate 18 may have a thickness, as measured from the inside surface 29 to an exterior surface 40 of the nozzle plate, of between about 5 micrometers (μm) and about 100 μm, or between about 25 μm and about 75 μm, or between about 40 μm and about 60 μm. The nozzle plate 18 may further have a thickness, as measured from the exterior surface 40 of the nozzle plate 18 to an intermediate surface 42, of between about 5 micrometers (μm) and about 50 μm, or between about 10 μm and about 40 μm, or between about 20 μm and about 30 μm. Each recess 30, 32, 34 may have a depth of between about 5 μm and about 50 μm, or between about 10 μm and about 40 μm, or between about 20 μm and about 30 μm. The compliant layer 36 may have a thickness of between about 5 μm and about 50 μm, or between about 10 μm and about 40 μm, or between about 20 μm and about 30 μm. The intermediate surface 42 is interposed at a level between the interior surface 29 of the nozzle plate and the exterior surface 40 of the nozzle plate.

In an embodiment, the compliant layer 36 may function as an adhesive to physically connect the nozzle plate 18 to the printhead manifold as depicted in FIG. 1, such that additional adhesive is not required. Thus the compliant layer 36 forms a portion of the sealed pocket 38 as well as functioning as an adhesive to physically connect the nozzle plate 18 to the printhead manifold, such as to the inlet/outlet plate 20. In an embodiment, air within the sealed pocket 32 is separated from ink within the first section of the ink channel 14A only by the compliant layer 36.

In an embodiment, a sealed pocket 38 may be formed adjacent to an ink channel 14 as depicted in FIG. 1. In an embodiment, each ink channel 14 supplies ink to only a single nozzle 16 and a separate sealed pocket 38 may be formed for each ink channel that supplies ink to a nozzle 16. In another embodiment, a singled sealed pocket 38 may be formed for a plurality of ink channels 14 such that a single sealed pocket 38 attenuates acoustic energy form more than one ink channel 14 during use of the printhead.

The formation of apertures such as nozzles 16 and purge vents 35 in a nozzle plate becomes more difficult with decreasing aperture widths/diameters. For example, a chemical etching process may be used to provide well-formed aperture diameters down to a minimum of about 75 to 100 microns. With smaller diameters, the aperture may become malformed due in part to the "bird's beak" effect, which has a larger effect on the aperture with decreasing diameters. Malformed apertures may have, for example, unreliable ink ejection trajectories during printing. Printheads, particularly with future generations, may require aperture diameters down to 15 microns or even less. It is anticipated that embodiments of the present teachings may provide a plurality of nozzle plate apertures having a diameter as small as 2 μm or less. Embodiments of the present teachings, therefore, may include apertures 16, 35 and recesses 30, 32, 34 within the nozzle plate 18 formed using an electroforming process such as one similar to that depicted in the cross sections of FIGS. 3-8.

Figure 3:
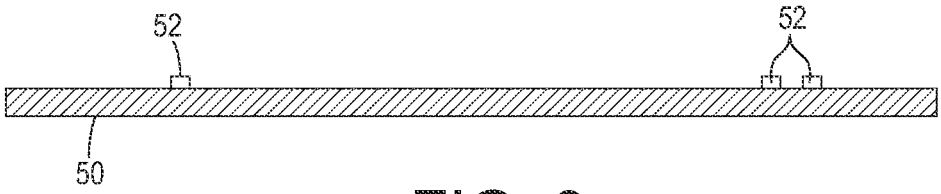
FIGS. 3-8 are cross sections depicting an embodiment of the present teachings for forming a nozzle plate using an electroforming process, for example a photolithographic electroforming process.

In FIG. 3, an electroforming mandrel (i.e., master) 50 is used as a cathode base electrode for a first patterned photoresist layer 52 and for subsequent electroformed layers. The first patterned photoresist layer 52 may be formed on the mandrel 50 using a photolithographic process as known in the art. As depicted, the first resist layer 52 covers first portions of the mandrel 50 and exposes second portions of the mandrel 50. Each portion of the first resist layer 52 may have a width or diameter (herein, collectively, a width) of between about 10 μm and about 20 μm, or about 15 μm. Because the first photoresist layer 52 is used to define the aperture openings 16, 35 and is formed using a precise photolithographic process, the aperture openings 16, 35 may be formed to have a precise size, shape, and position through the nozzle plate 18.

Figure 4:
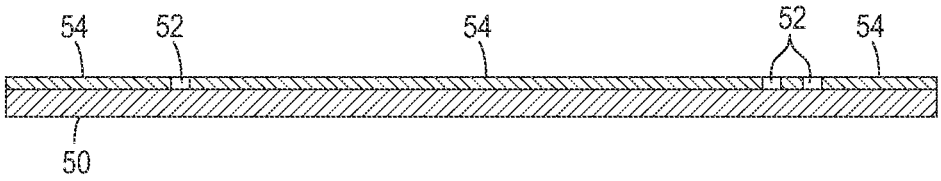

Subsequently, an electroforming process as known in the art may be used to deposit (grow) a first patterned electroformed layer 54 as depicted in FIG. 4 within an electroplating solution (not depicted for simplicity). In an embodiment, the first electroformed layer 54 may be formed to a suitable thickness, for example between about 5 μm and about 50 μm, or between about 10 μm and about 40 μm, or between about 20 μm and about 30 μm. After forming a first electroformed layer 54, the mandrel 50 is removed from the electroplating solution and a cleaning process may be performed to remove the first photoresist layer 52 and to prepare the exposed surface of the first electroformed layer 54 for a second electroformed layer. A suitable cleaning process may include methods to remove oxides and/or contaminates.

Figure 5:
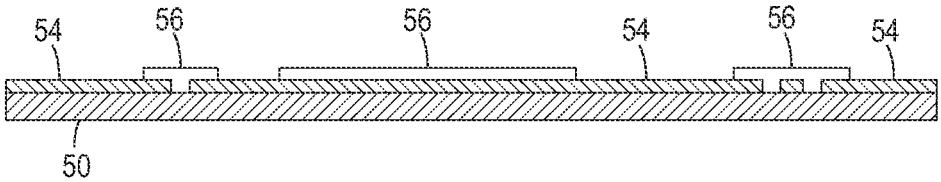
Figure 6:
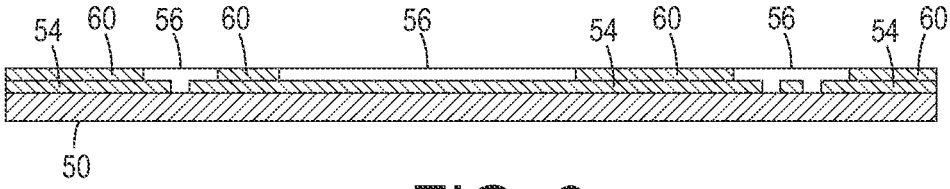

Next, a second patterned photoresist layer 56 may be formed on the exposed surface of the first electroformed layer 54 as depicted in FIG. 5 using a photolithographic process to align the resist layer 56 with the openings defined by first resist layer 52. As depicted in FIG. 5, the second patterned photoresist layer 56 covers first portions of the first patterned electroformed metal layer 54 and exposes second portions of the first patterned electroformed metal layer 54. The second patterned photoresist layer 56 may be used to define recesses 30-34 and possibly other structures as well. The FIG. 5 structure is then placed within an electroplating solution, and an electroforming process is used to form a second electroformed layer 60 as depicted in FIG. 6.

Figure 7:
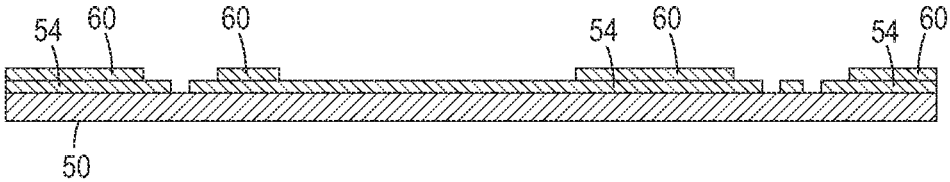

Subsequently, the second patterned photoresist layer 56 is removed to result in a structure similar to that depicted in FIG. 7, then the first electroformed layer 54 and the second electroformed layer 60 are removed from the mandrel 50 to result in the nozzle plate 18 of FIG. 8.

Figure 8:
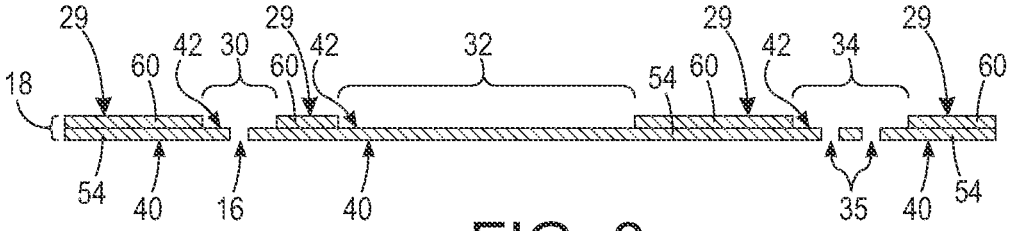

Thus the electroformed nozzle plate 18 of FIG. 8 may include apertures 16, 35 that have target sizes and shapes that are smaller and more precisely formed than is possible with, for example, a chemically etched metal stock. However, for some uses, a nozzle plate formed using a chemical and/or mechanical etch may be suitable.

The electroforming process used to form nozzle plate 18 thus forms the recess 30 (a pre-aperture opening for nozzle 16) at a first nozzle plate location, recess 32 (a recess in the inside surface of the nozzle plate that forms a portion of the sealed pocket 38) at a second nozzle plate location, recess 34 (a pre-aperture opening for purge vents 35) at a third nozzle plate location, and intermediate surface 42 as depicted in FIG. 8. The first patterned electroformed metal layer 54 provides an outside surface 40 and an intermediate surface 42 of the nozzle plate 18. The second patterned electroformed metal layer 60 provides an inside surface 29 of the nozzle plate 18, wherein the intermediate surface 42 is interposed at a level between a level of the outside surface 40 and the inside surface 29.

In another embodiment (not depicted for simplicity), a laser-patterned mask may be used during an etching process that forms the recesses 30, 32, 34. Nozzles 16 may be subsequently formed using a drilling process, for example a laser process or an etching process using a wet or dry etchant.

The intermediate surface 42 of the nozzle plate 18 at recesses 30 and 34 provides pre-aperture openings that are precisely aligned to the nozzle 16 and the purge vents 35, particularly when the recesses 30, 32, 34 are defined using a photolithographic process as depicted in FIGS. 3-8. To connect a polymer nozzle plate to a manifold, some current printheads include a pre-formed adhesive between the manifold and the nozzle plate that has openings wider than the apertures (for example, nozzles and purge vents) to provide pre-aperture openings. These current printheads may be assembled using a manual process to align the polymer aperture plate to the adhesive layer. A manual alignment process of a polymer nozzle plate to a pre-patterned adhesive layer can be difficult, for example because both materials have a high moisture absorption rate and high coefficients of thermal expansion. These characteristics can lead to a high variation in placement due to subtle changes in ambient temperature and humidity within the manufacturing area. This variation increases proportionally with nozzle density and printing width. In an embodiment, the pre-aperture openings at recesses 30, 34 may be formed using a highly precise photolithographic and electroforming process, and are thus precisely aligned with the apertures 16, 35. Edges of the compliant layer 36 may be formed away from edges of the recesses 30, 34 as depicted in FIG. 1.

In an embodiment, the nozzle plate 18 may be a nickel or nickel alloy formed, for example, using an electrodeposited metal process (electroforming). In other embodiments, the nozzle plate 18 may be formed from another metal, metal alloy, or non-metal material, or combinations thereof.

Thus an embodiment of the present teachings may have advantages over a polymer nozzle plate while providing sufficient attenuation of acoustic energy. For example, a nickel or nickel alloy aperture plate allows for precision alignment of pre-aperture openings to nozzles 16, purge vent apertures 35, or other apertures using a highly precise photolithographic electroforming process as described above. Additionally, dimpling of a polymer nozzle plate that may occur during formation of nozzles 16, apertures 35, and/or pre-aperture openings is reduced or eliminated with a nickel or other metal nozzle plate which has a higher modulus, and thus more robustly resists dimpling. Dimpling is known to cause variation in the directionality of ink as it is ejected from the nozzle in the nozzle plate, and therefore is to be avoided. Further, because a metal nozzle plate has a higher modulus than a polymer plate, a metal plate is more resistant to wear and scratches. Also, a metal nozzle plate is much more dimensionally stable than a polymer nozzle plate due to the significantly lower moisture absorption and coefficient of expansion rates.

While FIG. 1 is a cross section depicting a portion of an exemplary printhead, a single nozzle, and two purge vents, it will be understood that the cross section of FIG. 1 may be repeated across a printhead hundreds or thousands of times, and that other printhead designs are contemplated.

Figure 9:
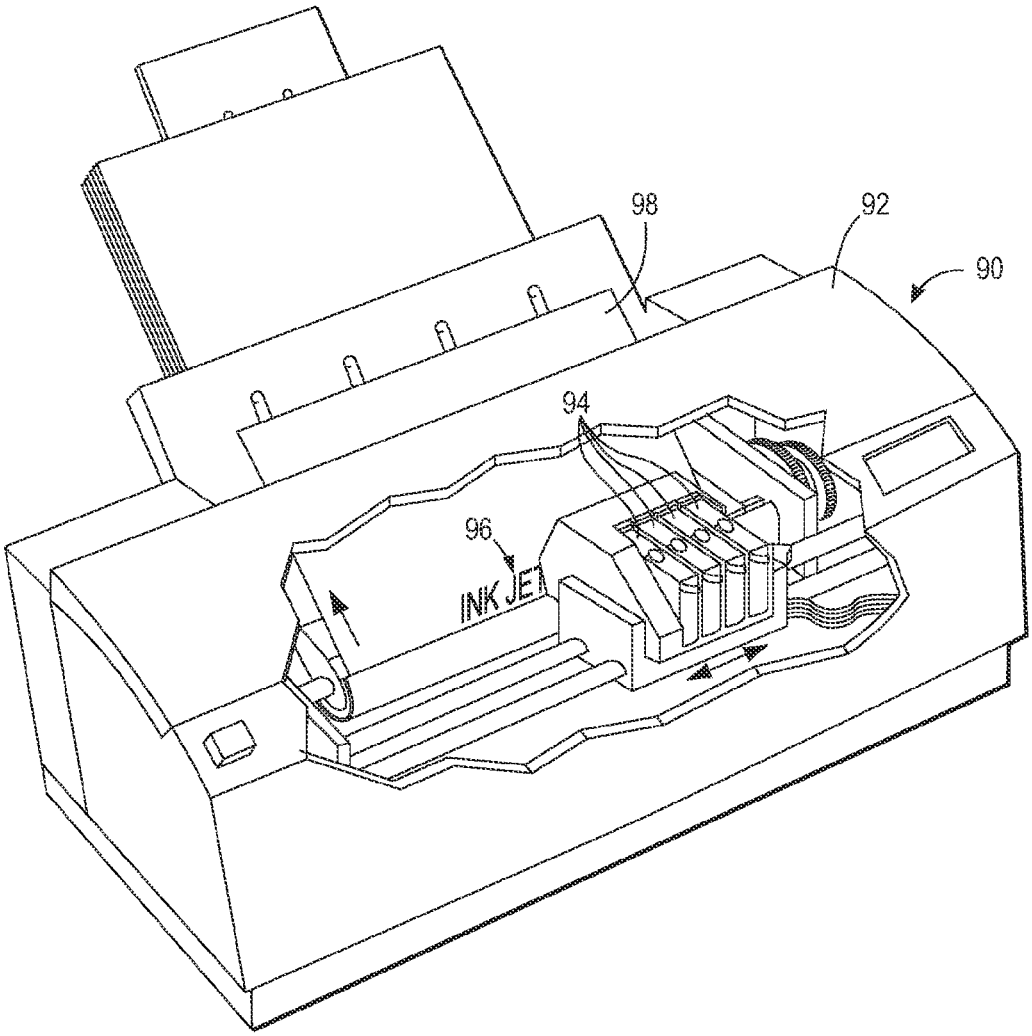
FIG. 9 is a perspective depiction of a printer including one or more printheads in accordance with an embodiment of the present teachings.

FIG. 9 depicts a printer 90 including a printer housing 92 into which at least one printhead 94 including an embodiment of the present teachings has been installed. The housing 92 may encase the printhead 94. During operation, ink 96 is ejected from one or more printheads 94. The printhead 94 is operated in accordance with digital instructions to create a desired image on a print medium 98 such as a paper sheet, plastic, etc. The printhead 94 may move back and forth relative to the print medium 98 in a scanning motion to generate the printed image swath by swath. Alternately, the printhead 94 may be held fixed and the print medium 98 moved relative to it, creating an image as wide as the printhead 94 in a single pass. The printhead 94 can be narrower than, or as wide as, the print medium 98. In another embodiment, the printhead 94 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An ink jet printhead, comprising:

a printhead manifold comprising an ink chamber therein;

a nozzle plate comprising a metal layer, wherein the metal layer comprises:

an outside surface;

an inside surface opposite the outside surface;

a first intermediate surface at a level between the outside surface and the inside surface;

at least one nozzle from which ink is ejected during printing;

a first recess around the nozzle and at least partially defined by the first intermediate surface; and a second recess at least partially defined by the first intermediate surface; and a thermoplastic compliant layer attached to the inside surface of the metal layer, wherein the thermoplastic compliant layer covers the second recess and forms a sealed pocket within the nozzle plate, the sealed pocket defined in part by the first intermediate surface of the metal layer.

2. The ink jet printhead of claim 1, further comprising a gas within the sealed pocket and ink within the ink chamber.

3. The ink jet printhead of claim 2, wherein the ink within the ink chamber is separated from the gas within the sealed pocket by the compliant layer.

4. The ink jet printhead of claim 1, wherein the compliant layer is an adhesive that physically attaches the nozzle plate to the printhead manifold.

5. The ink jet printhead of claim 4, further comprising a gas within the sealed pocket and ink within the ink chamber.

6. The ink jet printhead of claim 1, wherein the nozzle plate is an electroformed metal comprising nickel.

7. The ink jet printhead of claim 1, wherein the nozzle plate further defines at least one nozzle therein from which ink is ejected during printing.

8. An ink jet printer, comprising:

a printhead, comprising:

a printhead manifold comprising an ink chamber therein;

a nozzle plate comprising a metal layer, wherein the metal layer comprises:

an outside surface;

an inside surface opposite the outside surface;

a first intermediate surface at a level between the outside surface and the inside surface;

at least one nozzle from which ink is ejected during printing;

a first recess around the nozzle and at least partially defined by the first intermediate surface; and a second recess at least partially defined by the first intermediate surface; and a thermoplastic compliant layer attached to the inside surface metal layer, wherein the thermoplastic compliant layer covers the second recess and forms a sealed pocket within the nozzle plate, the sealed pocket defined in part by the first intermediate surface of the metal layer; and a housing that encases the printhead.

9. The ink jet printer of claim 8, further comprising gas within the sealed pocket and ink within the ink chamber.

10. The ink jet printer of claim 9, wherein the ink within the ink chamber is separated from the gas within the sealed pocket by the compliant layer.

11. The ink jet printer of claim 8, wherein the compliant layer is an adhesive that physically attaches the nozzle plate to the printhead manifold.

12. The ink jet printer of claim 11, further comprising a gas within the sealed pocket and ink within the ink chamber.

13. The ink jet printer of claim 8, wherein the nozzle plate is an electroformed metal comprising nickel.

14. The ink jet printer of claim 8, wherein the nozzle plate further defines at least one nozzle therein from which is ejected during printing.

* * * * *